United States Patent [19]

Tompkins, Jr.

[11] Patent Number: 4,513,797

[45] Date of Patent: Apr. 30, 1985

[54] ONE-PIECE LIQUID FILLER TUBE

[75] Inventor: Roy J. Tompkins, Jr., Louisville, Ky.

[73] Assignee: The Tomkins Co., Louisville, Ky.

[21] Appl. No.: 620,663

[22] Filed: Jun. 14, 1984

[51] Int. Cl.[3] ..... B65B 3/18; B65B 3/22

[52] U.S. Cl. ..... 141/198; 141/40; 141/59; 141/286

[58] Field of Search ..... 141/40, 54, 57, 58, 141/59, 198, 286, 308

[56] References Cited

U.S. PATENT DOCUMENTS 4,410,108 10/1983 Minard ..... 141/286 X

FOREIGN PATENT DOCUMENTS 1096231 12/1960 Fed. Rep. of Germany ..... 141/308

*Primary Examiner*—Stephen Marcus
*Assistant Examiner*—Mark John Thronson
*Attorney, Agent, or Firm*—Richard L. Caslin

[57] ABSTRACT

This invention relates to the art of high speed bottle filling machines and particularly to the use of a one-piece liquid filler tube that is inserted down through the neck of a bottle and is adapted to be joined to a tank of the bottle filling machine. The filler tube has an outer tube with an open upper end furnished with an external mounting that is joined to a tank of the bottle filling machine as well as capable of temporarily sealing the mouth of the bottle during the filling. The lower end of the outer tube has a conical tip with a series of large radially spaced discharge holes, and a second series of large radially spaced discharge holes formed in the outer tube adjacent the first series. A coarse mesh screen covers each discharge hole. An inner vent tube extends completely through the outer tube and is joined through the conical tip at the lower end and extends upwardly beyond the open upper end of the outer tube so as to exhaust air from the bottle so the liquid can displace the air leaving the bottle. The inner vent tube has an intermediate conduit that is joined through the wall of the outer tube and serves as a bottle fill height limit means. The combined area of the discharge holes in the outer tube is greater than the effective transverse annular area between the inner vent tube and the outer tube so the liquid is subdivided by the plurality of discharge holes into low pressure, non-turbulent streams to prevent foaming.

9 Claims, 5 Drawing Figures

FIG. 1
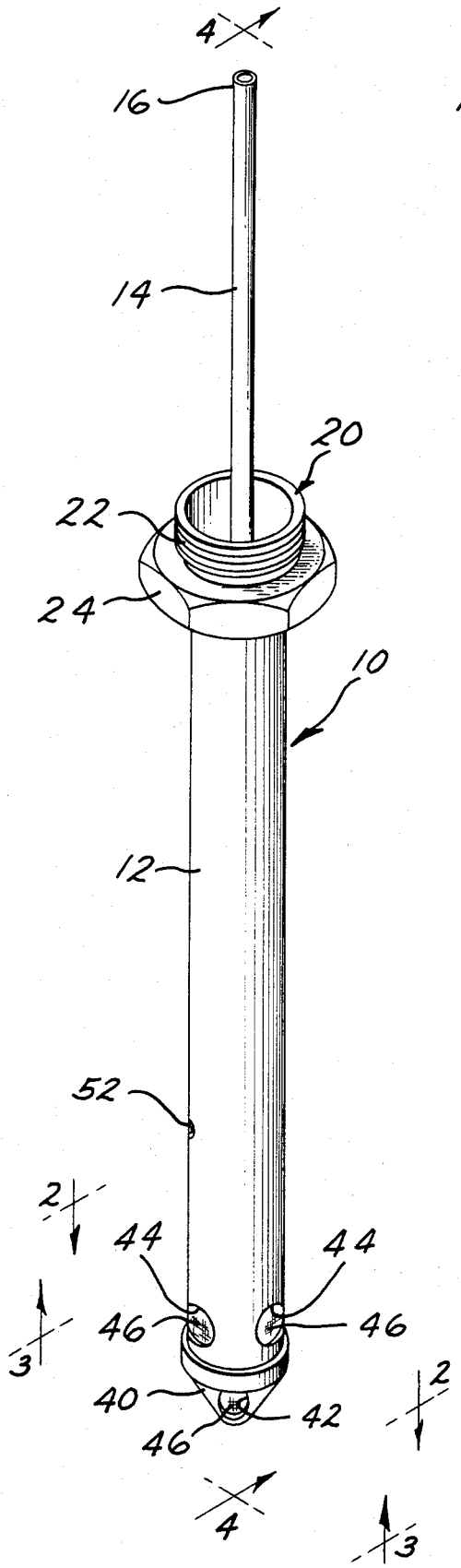
FIG. 2
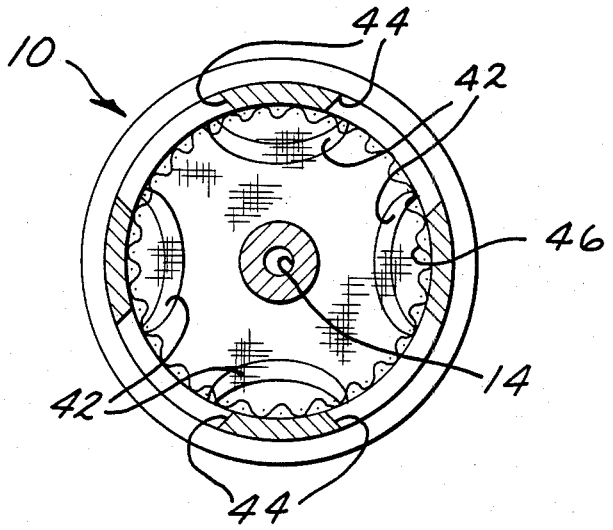
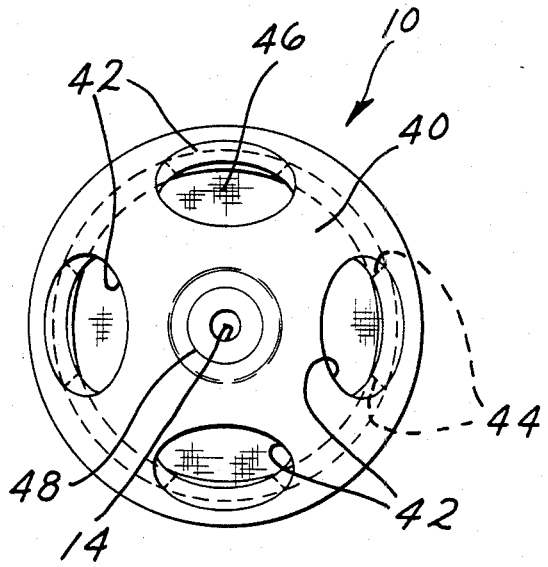
FIG. 3

ONE-PIECE LIQUID FILLER TUBE

BACKGROUND OF THE INVENTION

1. Field of the Invention

This invention relates to the art of liquid-dispensing tubes for use in filling containers such as whiskey bottles at high speed while reducing foaming and the need for recirculating the foam.

2. Description of the Prior Art

The whiskey distillery industry has employed liquid-dispensing tubes as part of automatic filling machines for filling the whiskey bottles at high rates of speed while controlling foaming and the need for recirculating the foam. One early patent is the Waxlax U.S. Pat. No. 3,741,263. This patent describes a liquid-dispensing tube of two-piece construction having relatively slideable concentric tubes. The center tube is a fixed vent tube that is inside the movable outer tube that is, in turn, urged downwardly by a coiled spring. The lower end of the filling tube is a hollow valve plug that has, at one end, an outlet port for liquid, and, at its opposite end, an inlet port for air. When the mouth of the bottle is raised around the lower end of the filling tube, it slides the filling tube up into the sleeve of the filling tank against the action of the spring. As the filling tube moves upwardly into the sleeve, the lower end of the tube uncovers the two ports in the hollow valve plug to allow liquid to pour out of the outlet port of the valve and into the bottle as the air is drawn upwardly through the inlet port.

The McLennand U.S. Pat. No. 3,805,856 describes a liquid-dispensing tube having a porous nozzle at its lower end secured to a filler tube. There is a central vertical filling tube that is surrounded by a concentric outer tube, the upper end of which is connected to means for producing a vacuum or suction within the tube. The patentable novelty appears to relate to the hollow, porous nozzle at the lower end of the tube which employs concentric inner and outer screens.

The Sanchis U.S. Pat. No. 2,885,127 relates to a device for dispensing liquids from a large bottle and particularly to an automatic liquid-dispensing device provided with a removable pin. This patent makes reference to transferring costly liquids from one large container into a smaller bottle, such as an eye drop bottle. This liquid-dispensing device is readily adjustable to varying heights of transfer bottles, such as eye drop bottles. The vertical movement of the pin causes the air inlet valve to open the air vent tube in order to allow air to enter the bottle through the air inlet port.

The Kelly U.S. Pat. No. 3,415,294 relates to a filling machine for introducing liquids into a container, while minimizing the formation of foam, comprising a plurality of relatively closely-spaced fine mesh screens at the discharge opening, whereby the effective head on the liquid is substantially reduced. In this manner, a higher head pressure can be used while the liquid at the discharge has a minimum of energy. This patent speaks of milk as the liquid that is being introduced into the containers.

The Schevey et al U.S. Pat. No. 4,279,279 relates to bottle-filling machines for chemicals that are used in semiconductor processing, where the chemicals must be available with extremely low particulate contamination counts. The invention of this patent relates to apparatus for automatically filling bottles with high purity liquid without either mechanical moving parts over the bottle openings or contact between the filler head or associated structures and the bottle, either of which can generate particulate contamination which falls into the bottle.

The Picut U.S. Pat. No. 2,482,867 relates to a liquid-dispensing device having a spring-closed valve and a vent pipe having a spring-closed closure, which vent valve closure is opened when the discharge valve is opened, thereby allowing the discharge of liquid into a receptacle until the liquid level in the receptacle rises above the lower end of the vent pipe.

OBJECTS OF THE PRESENT INVENTION

The principal object of the present invention is to provide a one-piece liquid filler tube having a lower end with two series of large radially spaced discharge holes in staggered positions so as to subdivide the liquid discharge into a plurality of low pressure, non-turbulent streams of increased volumetric flow with decreased foaming.

A further object of the present invention is to provide a liquid filler tube of the class described where the discharge holes are covered with a coarse mesh screen so as to increase the volumetric flow of liquid from the discharge holes while reducing foaming and preventing dribbles of the liquid from the screen by capillary action when the flow has been terminated.

A further object of the present invention is to provide the liquid filler tube of the class described with an inner vent tube that extends completely through the outer tube and is joined at its lower end through the lower end of the outer tube and extends upwardly beyond the open upper end of the outer tube.

A further object of the present invention is to provide a liquid filler tube of the class described where the inner vent tube has an intermediate conduit that serves as a bottle fill height limit means.

SUMMARY OF THE INVENTION

The present invention provides a one-piece liquid filler tube for mounting to a tank of a high speed bottle filling machine. The tube is for insertion down through the narrow neck of a bottle. This filler tube has an outer tube with an upper end furnished with an external mounting for joining the tube to a tank of the bottle filling machine as well as to temporarily seal the mouth of the bottle during the filling operation. The lower end of the outer tube has a conical tip with a series of large radially spaced discharge holes, and there is a second series of large radially spaced discharge holes formed in the lower end of the outer tube, and they are generally staggered with respect to the first series. A coarse mesh screen covers each discharge hole. An inner vent tube extends completely through the outer tube. The lower end of the vent tube is joined through the conical tip of the outer tube and it extends upwardly beyond the upper end of the outer tube. This inner vent tube includes an intermediate conduit joined through the wall of the outer tube that serves as a bottle fill height limit means.

BRIEF DESCRIPTION OF THE DRAWINGS

This invention will be better understood from the following description taken in conjunction with the accompanying drawings, and its scope will be pointed out in the appended claims.

FIG. 1 is a top perspective elevational view of the one-piece liquid filler tube of the present invention.

FIG. 2 is a transverse cross-sectional plan view through the top series of large radially spaced discharge holes in the lower end of the outer tube taken on the line 2—2 of FIG. 1.

FIG. 3 is a bottom plan view of the conical tip of the liquid filler tube taken on the line 3—3 of FIG. 1.

DESCRIPTION OF THE PREFERRED EMBODIMENTS

Figure 4:
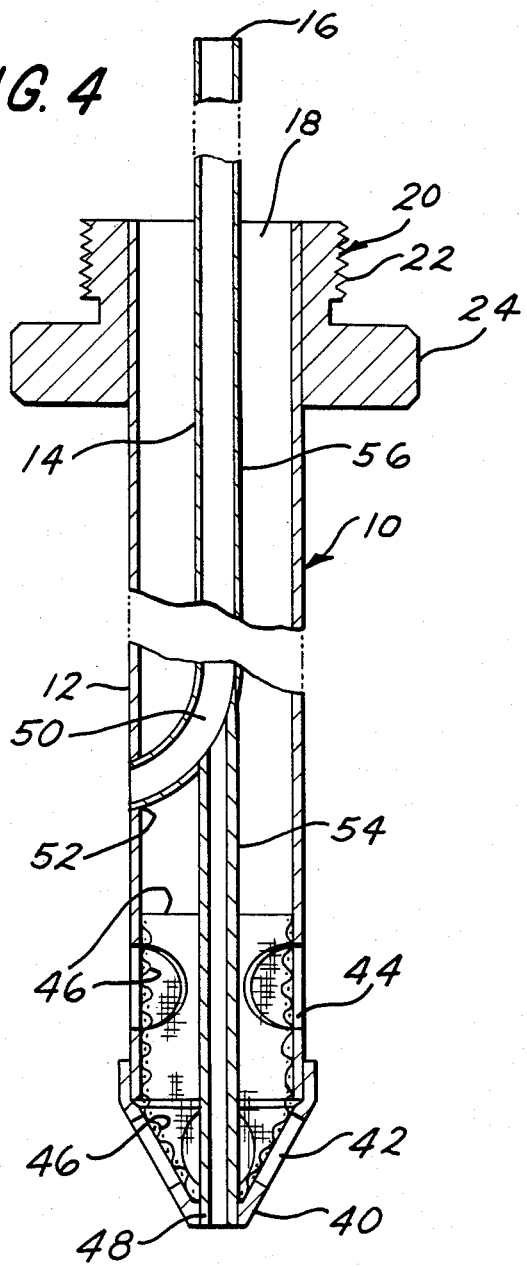
FIG. 4 is a cross-sectional elevational view of the liquid filler tube of FIG. 1 taken on the line 4—4 thereof and showing the central vent tube with an intermediate conduit joined through the wall of the outer tube and serving as bottle fill height limit means.

Turning now to a consideration of the drawings, and, in particular, to the top perspective elevational view of FIG. 1, there is shown a one-piece liquid filler tube 10 comprising the present invention. Perhaps in describing this invention reference should be made to both the full view of FIG. 1 and the cross-sectional view of FIG. 4. This filler tube 10 has a first elongated outer tube 12, and a second inner vent tube 14, as seen in the cross-sectional view of FIG. 4. This inner vent tube 14 extends completely through the outer tube 12 and it terminates at the top end 16 much above the top end 18 of the outer tube 12. This upper end 18 of the outer tube 12 is supplied with an external mounting bushing 20 that includes external threads 22 and a wrench-engaging hexagonal portion 24. This mounting bushing is adapted to be joined in an opening at the bottom of a tank of a high speed bottle filling machine (not shown), as is well known in this art. As is shown in FIG. 5, an annular spacer 26 is assembled on the outer tube 12 just beneath the wrench-engaging portion 24. Beneath this spacer 26 is an annular resilient seal 28 which is adapted to engage over the mouth 30 of the elongated neck 32 of the bottle 34. These empty bottles are brought to the machine on a conveyor and once they are positioned beneath the liquid filler tubes 10, the bottles are raised until the mouth 30 of the bottle bears against the reslient seal 28. Then the filling operation is set to begin. It will be understood that bottles are of different sizes and the necks 32 are of different heights. This can be accommodated by use of different types of spacers 26 and seals 28 in combination.

The lower end of the outer tube 12 is fitted with a conical tip 40 which is formed with a series of four large radially spaced discharge holes 42, as is best seen in the bottom plan view of FIG. 3. There is a second series of four large radially spaced discharge holes 44 in the lower end of the outer tube 12 adjacent the first series, but staggered with respect to the first series 42 as is clear from the cross-sectional plan view of FIG. 2 which is taken on the line 2—2 of FIG. 1 through the center of this second series of holes 44. As is best seen in the cross-sectional elevationl view of FIG. 4, a coarse 40 mesh, 0.010 diameter wire screen 46 covers the inside surface of each of the first series holes 42 as well as the second series holes 44.

Figure 5:
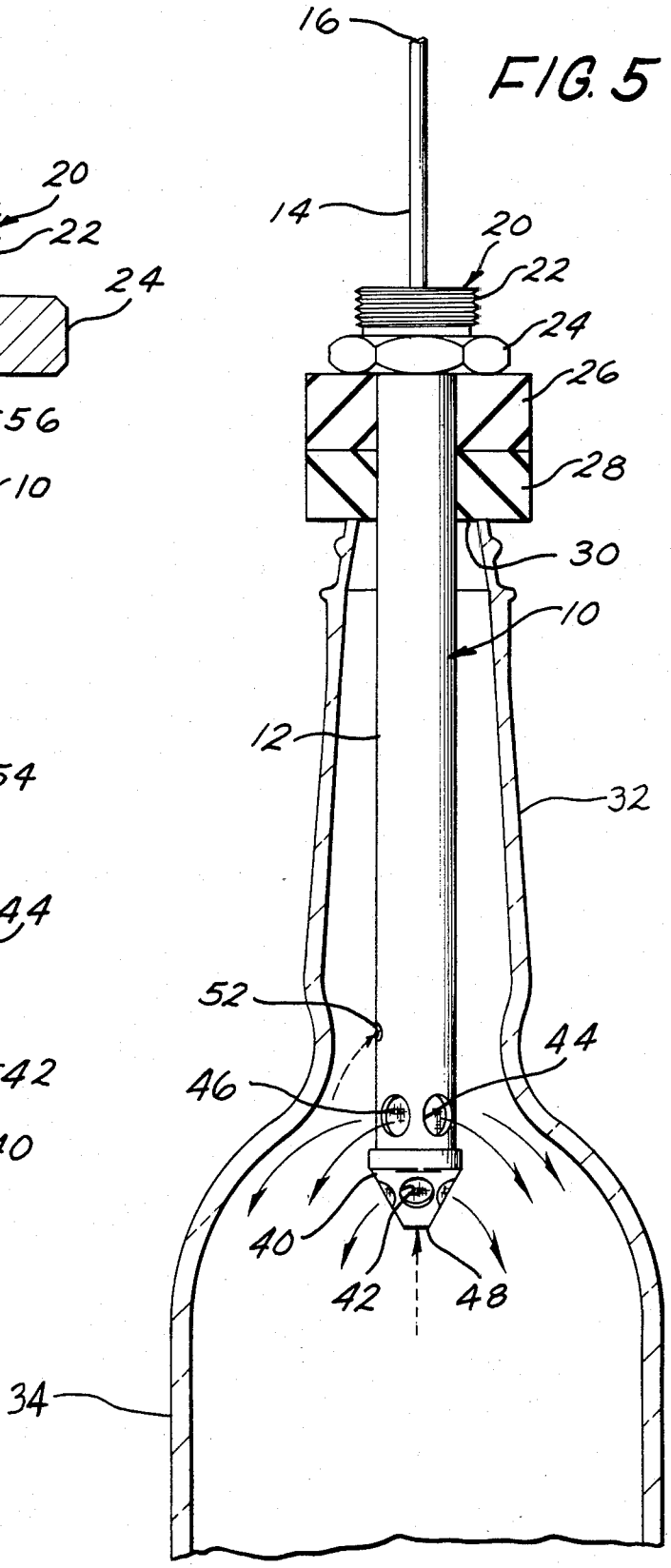
FIG. 5 is a front elevational view of the liquid filler tube similar to that of FIG. 1 but positioned in the neck of a bottle and sealed over the top of the bottle as would be the case during the machine filling operation.

Turning back to the cross-sectional elevational view of FIG. 4, it will be appreciated that the second inner vent tube 14 is of small diameter, and centrally located within the outer tube 12. This vent tube extends completely through the outer tube 12 and is joined at its lower end through the center of the conical tip 40, as at 48. This inner vent tube 14 may be considered as having an intermediate conduit 50 that is joined through the wall of the outer tube 12 as at 52. Thus the conduit 50 divides the vent tube 14 into a lower section 54 and an upper section 56, and this conduit serves as a bottle fill height limit means in that the filling action is terminated when this conduit opening at 52 is submerged by the liquid. The intermediate conduit 50 serves to reinforce the stability of the vent tube 14.

It will be understood by those skilled in this art that high speed bottle filling machines of the type in which this liquid filler tube is used are either of the gravity type or are vacuum machines where a vacuum is pulled on the vent tube 14. of course the present invention can be used with either the gravity or the vacuum system.

Special attention should be given to the relative sizes of the lower section 54 versus the upper section 56 of the vent tube 14. The internal diameter of the lower section 54 is smaller than the internal diameter of the upper section 56. One example would be the internal diameter of the lower section 54 may be 0.062 inches while the internal diameter of the upper section 56 may be 0.146 inches. Of course these dimensions may vary but the relative ratio would be generally the same without departing from the present invention. Moreover, the wall thickness of the upper section is smaller than the wall thickness of the lower section. For example, the wall thickness of the upper section 56 may be 0.005 inches as compared with wall thickness of about 0.031 inches. Also it should be noticed that the upper section 56 of the vent tube 14 and the intermediate conduit 50 are shown as being formed of the same tubular stock, where the conduit 50 has a gradual upwardly curved transition configuration which merges into the vertical upper section 56, somewhat in the shape of a hockey stick. This gives the conduit a streamlined configuration for a better non-turbulent flow of the air through the conduit and vent tube. It is desirable to have the internal area of the upper section of a maximum transverse area to carry off the air both from the lower section 54 as well as from the conduit 50, while at the same time having a minimum external size of the upper section so as not to unduly restrict the liquid flow down through the first tube 12 so as to be able to increase the volumetric flow while decreasing the velocity of flow creating a minimum of foaming. The problem of foaming is greater with liquids having a higher alcohol content (proof). One of the difficulties of foaming is that it then requires the foam to be recirculated through the vent tube and back into the tank of the bottle filling machine above the bottles. One of the objections of recirculating the foam is that it reduces the proof of the liquid and thus the value of the liquid. This recirculation pulls air through the liquid and it vaporizes. The present invention amounts to a culmination of a great amount of experimentation to derive the maximum benefit so as to produce a better product than has heretofore been available on the market. One observed improvement is that the product flow from the two series of discharge holes 42 and 44 appears to fall out of the discharge holes 42 and 44 having a stream filling about half of each hole so that the flow does not serve to break up the liquid into a turbulent flow that creates foam.

As illustrated in FIG. 5, it has been deemed preferable that the liquid filler tube 10 of the present invention is of such a length that the two series of discharge holes 42 and 44 are located within the bottle rather than within the neck so that the discharge does not take place within the neck.

This invention is noteworthy because it reduces the amount of foaming of the liquid, therefore it reduces the amount of recirculation of the foam. Moreover, this invention reduces the foaming by reducing the speed of discharge while at the same time increasing the volume of discharge by using a plurality of large radially spaced discharge holes which are clustered at the lower end of the filler tube so the discharge is preferably not within the neck of the bottle. The combined area of the two series of discharge holes 42 and 44 is greater than the effective annular area within the first outer tube 12 and outside the second vent tube 14. The tests are showing we are able to fill about 240 500 milliliter bottles (roughly a pint) per minute, and to gradually increase the speed to filling 300 such bottles per minute.

Modifications of this invention will occur to those skilled in this art. Therefore, it is to be understood that this invention is not limited to the particular embodiments disclosed, but that it is intended to cover all modifications which are within the true spirit and scope of this invention as claimed.

What is claimed is:

1. A liquid filler tube for insertion down through the neck of a bottle, said filler tube comprising:

a. a first elongated outer tube having an open upper end supplied with an external mounting connection adapted to be joined to a tank of a high speed bottle filling machine;

b. the lower end of the elongated tube having a conical tip with a wall and with a series of large radially spaced discharge holes in the wall, and a second series of large radially spaced discharge holes in the lower end of the said tube adjacent the conical tip and staggered with respect to the first series of discharge holes, and a coarse mesh screen covering each discharge hole;

c. and a second inner vent tube of smaller diameter extending completely through the elongated tube and joined at its lower end through the conical tip and at its upper end extending upwardly beyond the open upper end of the first tube;

d. the said vent tube having an intermediate conduit joined through the wall of the first tube and serving as a fill height limit means.

2. The liquid filler tube as recited in claim 1 wherein the combined area of the two series of discharge holes is greater than the effective transverse internal area of the first outer tube minus the effective transverse external area of the inner vent tube so as to speed up the flow of liquid down through the first tube while slowing down the actual flow of the liquid out through each of the large discharge holes.

3. The liquid filler tube as recited in claim 2 wherein the said vent tube is centrally located within the first tube, the vent tube has an upper section above the intermediate conduit and a lower section below the intermediate conduit, and the upper section is larger in internal diameter than the internal diameter of the lower section.

4. The liquid filler tube as recited in claim 2 wherein said vent tube has an upper section and a lower section, the said upper section and the said intermediate conduit are formed of the same tubular stock, where the conduit has a gradual upwardly curved transition configuration, while the said lower section of vent tube is joined to the upper section, and the lower section is of smaller internal diameter than the internal diameter of the upper section and conduit.

5. The liquid filler tube as recited in claim 4 wherein the wall thickness of the said upper section of the vent tube and the conduit is of minimum size so as to result in a maximum transverse internal area of the upper section with a minimum transverse external area so as not to unduly restrict the liquid flow down the said first tube and increase the speed of filling the bottle with a minimum of foaming.

6. A one-piece liquid filler tube for insertion down through the narrow neck of a bottle, said filler tube comprising:

a. an outer tube having an open upper end that is furnished with an external mounting adapted to be joined to a tank of a high speed bottle filling machine as well as to temporarily seal the mouth of the bottle during the filling operation;

b. the lower end of the outer tube having a conical tip with a wall and with a series of large radially spaced discharge holes formed in the wall, and a second series of large radially spaced discharge holes formed in the lower end of the outer tube adjacent the conical tip and generally vertically staggered with respect to the said first series, and a coarse mesh screen covering each discharge hole so as to speed up the volume of liquid flow from the holes while reducing foaming and preventing dribbles of the liquid from the screen by capillary action when the flow has been terminated;

c. and an inner vent tube of small diameter extending completely through the outer tube, and joined at its lower end through the conical tip, and extending upwardly beyond the open upper end of the outer tube so as to exhaust air from the bottle so the liquid can displace the air leaving the bottle;

d. the inner vent tube including an intermediate conduit joined through the wall of the outer tube and serving both to reinforce the stability of the inner tube and as a bottle fill height limit means.

7. The one-piece liquid filler tube as recited in claim 6 wherein the said conduit and the upper section of the inner vent tube are formed of the same thin wall tubular stock so as to result in a maximum transverse internal area with a minimum transverse external area and not unduly restrict the liquid flow down the outer tube, and the conduit has a gradual upwardly curved streamlined configuration.

8. The one-piece liquid filler tube as recited in claim 7 wherein the lower section of the inner vent tube is of smaller internal diameter than the internal diameter of the upper section for increasing the volume of liquid flow down the outer tube.

9. A one-piece liquid filler tube as recited in either claims 6, 7 or 8 wherein the combined area of the two series of discharge holes in the outer tube is greater than the effective transverse annular area between the inner vent tube and the outer tube so the liquid is subdivided by the plurality of discharge holes into low pressure, non-turbulent streams to prevent foaming.

* * * * *